US005489452A

United States Patent [19]

Case, Jr.

[11] Patent Number: 5,489,452

[45] Date of Patent: Feb. 6, 1996

[54] METHOD AND MANUFACTURE OF CREATING AN ORNAMENTAL TREE

[76] Inventor: Leonard S. Case, Jr., 998 Victoria St., Antioch, Ill. 60002

[21] Appl. No.: 108,890

[22] Filed: Aug. 18, 1993

[51] Int. Cl.[6] ..... A41G 1/00

[52] U.S. Cl. ..... 428/18; D11/118; 156/61; 362/123; 428/921

[58] Field of Search ..... 428/18, 921, 19–20, 428/7–17; 156/61; 362/123; D11/118

[56] References Cited

U.S. PATENT DOCUMENTS

| | | | |
|---|---|---|---|
| 1,472,709 | 10/1923 | Wiesenfeld | 428/18 X |
| 1,510,031 | 9/1924 | Beyer | 428/22 |
| 1,577,873 | 3/1926 | Root | 428/18 X |
| 1,773,824 | 8/1930 | Scheibner | 428/18 X |
| 1,784,474 | 12/1930 | Wilson | 428/19 X |
| 2,734,297 | 2/1956 | Dunklee | 428/22 |
| 3,967,019 | 6/1976 | Magee | 428/19 X |
| 4,435,452 | 3/1984 | Hernandez et al. | 428/18 X |
| 4,849,298 | 7/1989 | Raevsky | 428/921 X |
| 4,937,107 | 6/1990 | Mirisch, Sr. . | |

*Primary Examiner*—Henry F. Epstein
*Attorney, Agent, or Firm*—Michael R. McKenna

[57] ABSTRACT

This invention relates to a method and manufacture of creating an ornamental miniature tree comprising a decorated pine cone that has been treated with a fire retardant, strung with miniature holiday lights and uprightly attached to a base.

18 Claims, 2 Drawing Sheets

METHOD AND MANUFACTURE OF CREATING AN ORNAMENTAL TREE

BACKGROUND OF THE INVENTION

The ornamental use of pine cones for decorative ornaments includes the use as a decorative article, including a cone of a coniferous plant having decorative coating thereon, and providing therein an axial bore in which a bendable wire stem may be anchored to create a hinge to mount same is shown in U.S. Pat. No. 2,734,297. This disclosure relates to the use of a pine cone as an ornament on a tree. U.S. Pat. No. 4,435,452 discloses painted and glued pine cone scales; and U.S. Pat. No. 1,510,031 provides for a method of creating an artificial flower from a pine cone body.

Ornamental trees have derived from a variety of materials and methods. U.S. Pat. No. 3,967,019 provides for self-supporting ornamental artificial tree, having illumination means attached thereto. U.S. Pat. No. 4,937,107 discloses a string of electric lights on a simulated tree; and U.S. Pat. No. 1,784,474 discloses a method to illuminate objects.

ADVANTAGES OF THIS INVENTION

The invention relates to an ornamental tree manufactured from a mature dry pine cone having open scales and a stem. Unlike the pine cone shown in U.S. Pat. No. 2,734,297 which has a bendable wire anchored to the stem to allow the pine cone to be hung from the branch of a holiday tree as a decorative ornament, the pine cone of the instant invention stands alone as an individual miniature ornamental tree having its own base with a flat bottom surface where the pine cone may stand uprightly to resemble a tree. Such arrangement of the pine cone on a base is not taught nor suggested by the prior art.

So that it can be safely strung with electrical lights, a treatment of fire retardant material is applied. Such treatment may be applied to the base as well as to the pine cone. Such safety feature is not taught nor suggested by the prior art.

The invention is lightweight and easy to move about. It lends itself as a gift to those who may be hospitalized or situated transiently.

Thus, this invention provides for the first time an ornamental miniature tree made from a fire retardant treated pine cone that is positioned uprightly and illuminated with a sting of miniature holiday lights. In brief, this ornamental miniature tree invention provides a safe, inexpensive, and portable holiday tree which avoids fires and is easy to place and plug in to create a festive symbol of the holiday season, particularly for those who are incapacitated or otherwise unable to erect a fuller sized tree. Still other advantages will be apparent from the disclosure that follows.

SUMMARY OF THE INVENTION

The invention relates to an ornamental miniature tree comprising a pine cone having scales and a stem, that has been treated with a fire retardant and that is uprightly attached to a base that has a flat bottom surface.

The present invention may further comprise at least one miniature electric light.

BRIEF DESCRIPTION OF THE DRAWINGS

Preferred embodiments of the invention are described hereinafter with reference to the accompanying drawing wherein.

DETAILED DESCRIPTION OF THE INVENTION

Figure 1:
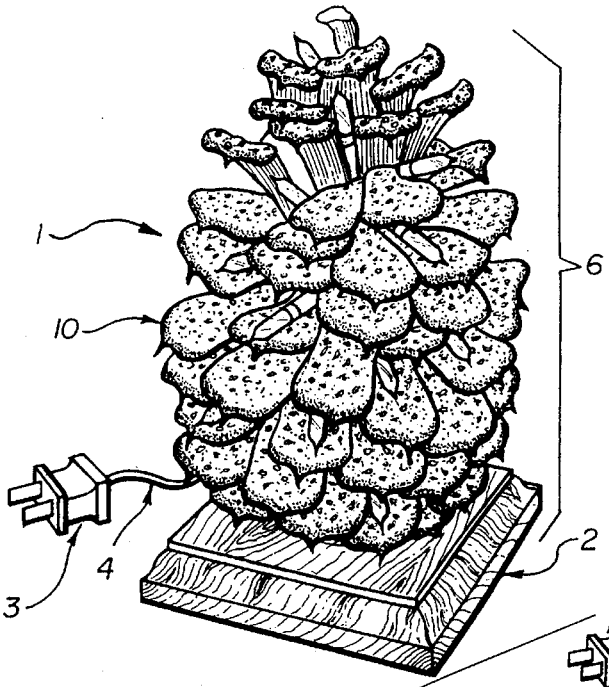
FIG. 1 is a perspective view of an ornamental tree having a pine cone with decorative coating and strung with miniature electric lights positioned uprightly and attached to a generally horizontal base.

The invention relates to a method and a manufacture of an ornamental miniature tree. Without departing from the generality of the invention disclosed herein and without limiting the scope of the invention, the discussion that follows, will refer to the invention as depicted in the drawing.

The preferred embodiments of the ornamental tree 1 depicted in the drawing comprise a mature dry pine cone 6 having open scales 10 and a stem 18, that has been treated with a fire retardant 24 and that is uprightly attached to a base 2 that has a flat bottom surface 26.

Figure 2:
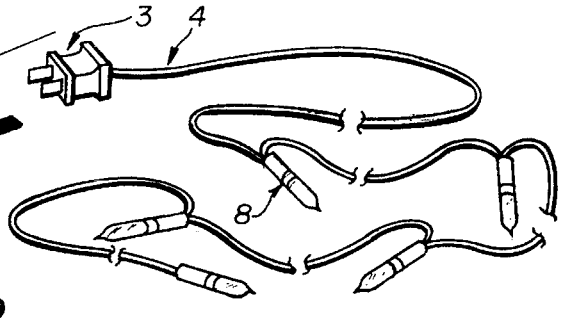
FIG. 2 is an exploded perspective view of the ornamental tree of FIG. 1 with the miniature electric lights and the base separated from the pine cone and showing a central vertical bore in the base and a screw and washer for securing the base to the pine cone.
Figure 2:
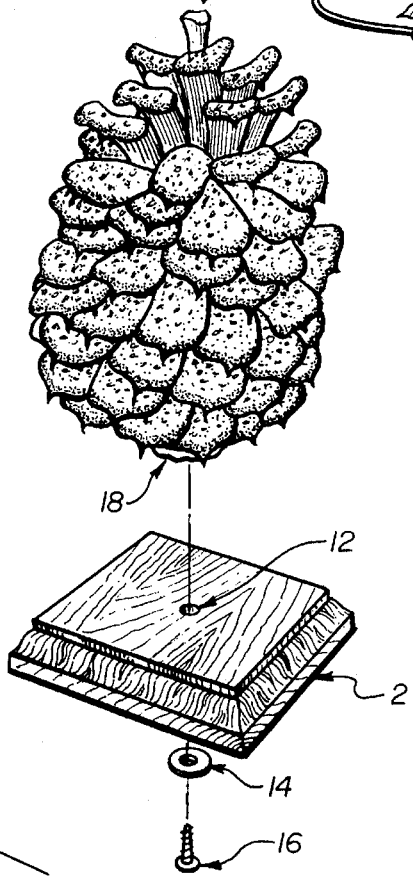
Figure 3:
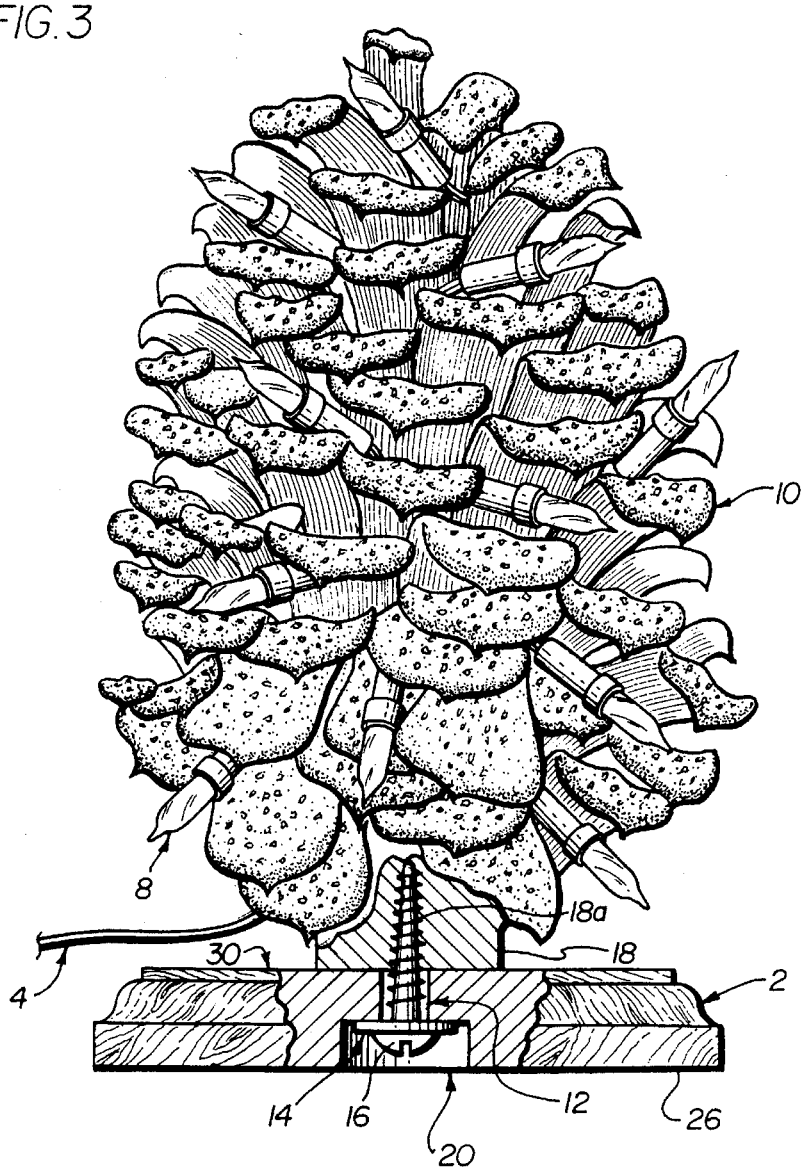
FIG. 3 is a side elevation view of the ornamental tree of FIG. 1 with a fragmentary view of the base and the stem of the pine cone showing details of the central bore of said base and the stem, respectively, and the position of the screw and washer attaching the base and pine cone.

In the preferred embodiment shown in FIGS. 2 and 3, the stem 18 of the pine cone 6 has an axial borehole **18*a* and the base 2 has a centrally disposed bore (shown in the drawing as a stepped bore and identified by numerals 12 and 20, and hereinafter collectively identified by numeral 32) transverse to the flat bottom surface 26**. Alternatively, a single diameter bore having a recess adapted to receive a recessed screw may be employed. An embodiment not shown in the drawing comprises a means for attaching employing an adhesive, such as glue, and a dowel.

The axial borehole **18*a* and bore 32 are arranged concentrically and each is respectively sized and adapted to securingly accept the means for attaching the pine cone 6 to the base 2, which as shown in the drawing is a washer 14 and screw 16**.

Figure 4:
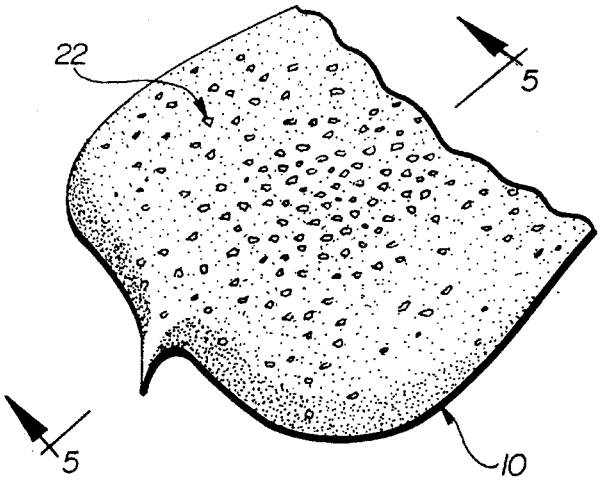
FIG. 4 is an enlarged perspective view of the tip portion of a pine cone scale having a decorative coating.
Figure 5:
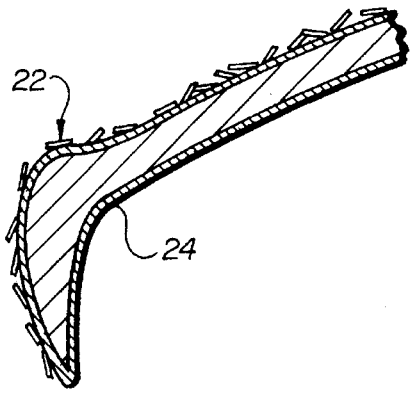
FIG. 5 is a cross section view of the tip portion of the pine cone scale taken along the line 5—5 of FIG. 4 showing a fire retardant film coating and flecks of the decorative coating on the pine cone scale.

As shown in FIGS. 4 and 5, a decorative material coating 22 may be applied to the pine cone 6.

Since the pine cone 6 is treated with a fire retardant material 24, the ornamental tree may be safely illuminated with one or more miniature electric lights. As shown in FIGS. 1 and 2, a standard string of miniature Christmas lights, having a plug 3, a cord 4, and a plurality of miniature lights 8, may be strung around the scales 10 of the pine cone 6.

The instant invention teaches methods of manufacturing an ornamental miniature tree 1, one of which comprises the following steps:

a. flattening the bottom surface 26 of a base 2 and contouring the centrally disposed portion of the upper surface 30 of the base 2;

b. contouring the end of the stem 18 to match centrally disposed portion of the upper surface 30 of the base 2, so that the pine cone 6 may be uprightly positioned there;

c. treating said pine cone 6 with a fire retardant 24;

d. positioning said pine cone 6 uprightly with the end of the stem 18 in contact with the centrally disposed portion of the upper surface 30 of the base 2; and e. attaching the end of the stem 18 to the centrally disposed portion of the upper surface 30 of the base 2.

Another method of manufacturing an ornamental miniature tree 1 taught by the instant invention comprises the following steps:

a. flattening the bottom surface of a base, drilling a centrally disposed bore transverse to the flat bottom surface, and contouring the centrally disposed portion of the upper surface thereof;

b. drilling an axial borehole in the stem of the pine cone and contouring the end of the stem to match centrally disposed portion of the upper surface of the base, so that the pine cone may be uprightly positioned there;

c. treating said pine cone with a fire retardant;

d. arranging concentrically said axial borehole of the stem and said bore of the base for receipt of a screw; and e. attaching the base to the pine cone by connecting the axial borehole to the bore of the base with the screw.

Additional steps that may be employed with the methods of manufacturing above set forth comprise the step of applying a decorative material coating to the pine cone and/or the step of applying at least one miniature electric light. Alternatively, an adhesive, such as glue, and a dowel, may replace the screw.

In the best mode currently known by the applicant, the fire retardant for treating said pine cone comprise ammonium phosphate. Ammonium sulfate, and salts of zinc and boron may also be used to retard the flammability of the pine cone and the base. Some fire retardant formulations also give protection against decay.

While this invention has been described in connection with the best mode presently contemplated by the inventor for carrying out his invention, the preferred embodiments described and shown are for purposes of illustration only, and are not to be construed as constituting any limitations of the invention. Modifications will be obvious to those skilled in the art, and all modifications that do not depart from the spirit of the invention are intended to be included within the scope of the appended claims.

What I claim is:

1. An ornamental miniature tree comprising a. a pine cone having scales and a stem,
said pine cone having certain of its root scales removed to define the stem thereof;

b. a base having a flat bottom surface;

c. a means for attaching the stem of the pine cone to the base,
said pine cone being uprightly positioned on said base; and d. said pine cone being treated with a fire retardant.

2. The ornamental miniature tree of claim 1 in which the stem of the pine cone has an axial borehole and the base has a centrally disposed bore transverse to the flat bottom surface, said axial borehole and bore being arranged concentrically and each being respectively sized and adapted to securingly accept the means for attaching the pine cone to the base.

3. The ornamental miniature tree of claim 2 in which themeans for attaching the pine cone to the base comprises a screw.

4. The ornamental miniature tree of claim 3 in which a. the ornamental miniature tree further comprises a string of miniature Christmas tree lights strung on said pine cone; and b. the pine cone has a decorative material coating.

5. The ornamental miniature tree of claim 2 in which the means for attaching the pine cone to the base comprises a dowel and glue.

6. The ornamental miniature tree of claim 5 in which a. the ornamental miniature tree further comprises a string of miniature Christmas tree lights strung on said pine cone; and b. the pine cone has a decorative material coating.

7. The ornamental miniature tree of claim 1 further comprising the pine cone being treated with a decorative material coating.

8. The ornamental miniature tree of claim 1 further comprising said pine cone being strung with at least one miniature electric light.

9. The ornamental miniature tree of claim 1 in which the fire retardant for treating said pine cone comprises ammonium phosphate.

10. The ornamental miniature tree of claim 9 in which a. the ornamental miniature tree further comprises a string of miniature Christmas tree lights strung on said pine cone; and b. the pine cone has a decorative material coating.

11. The ornamental miniature tree of claim 1 further comprising a string of miniature Christmas tree lights strung on said pine cone.

12. The ornamental miniature tree of claim 11 in which a. the ornamental miniature tree further comprises a string of miniature Christmas tree lights strung on said pine cone; and b. the pine cone has a decorative material coating.

13. A method of manufacturing an ornamental miniature tree, which comprises:

a. flattening a bottom surface of a base and contouring a centrally disposed portion of an upper surface thereof;

b. removing certain root scales of a pine cone to define a stem having an exposed end;

c. contouring the exposed end of the stem to match said centrally disposed portion of the upper surface of the base, so that the pine cone may be uprightly positioned there;

d. treating said pine cone with a fire retardant;

e. positioning said pine cone uprightly with the exposed root end of the stem in contact with the centrally disposed portion of the upper surface of the base;

f. attaching the exposed end of the stem to the centrally disposed portion of the upper surface of the base.

14. The method of manufacturing an ornamental miniature tree of claim 13, further comprising the step of applying a decorative material coating to the pine cone.

15. The method of manufacturing an ornamental miniature tree of claim 13, further comprising the additional step of applying at least one miniature electric light having a cord and plug.

16. The method of manufacturing an ornamental miniature tree of claim 15, further comprising the additional step of securing the cord to the means for attaching the pine cone to the base.

17. A method of manufacturing an ornamental miniature tree, which comprises:

a. removing certain root scales of a pine cone to define a stem having an exposed end;

b. treating said pine cone with a fire retardant;

c. flattening a bottom surface of a base, drilling a centrally disposed bore transverse to the flat bottom surface, and contouring a centrally disposed portion of an upper surface thereof;

d. drilling an axial borehole in the stem of the pine cone and contouring the exposed end of the stem to match said centrally disposed portion of the upper surface of the base, so that the pine cone may be uprightly positioned thereon;

e. arranging concentrically said axial borehole of the stem and said bore of the base for receipt of a screw; and f. attaching the base to the pine cone by connecting the axial borehole of the stem to the bore of the base with the screw.

18. A method of manufacturing an ornamental miniature tree, which comprises:

a. removing certain root scales of a pine cone to define a stem having an exposed end;

b. treating said pine cone with a fire retardant;

c. flattening a bottom surface of a base, drilling a centrally disposed bore transverse to the flat bottom surface, and contouring a centrally disposed portion of an upper surface thereof;

d. drilling an axial borehole in the stem of the pine cone and contouring the exposed end of the stem to match said centrally disposed portion of the upper surface of the base, so that the pine cone may be uprightly positioned thereon;

e. arranging concentrically said axial borehole of the stem and said bore of the base for receipt of a dowel;

f. applying glue to the dowel; and g. attaching the base to the pine cone by connecting the axial borehole of the stem to the bore of the base with the dowel.

* * * * *